US007982576B2

(12) United States Patent
Feng et al.

(10) Patent No.: US 7,982,576 B2
(45) Date of Patent: Jul. 19, 2011

(54) TRANSFORMER

(75) Inventors: Wen-Pin Feng, Taoyuan Hsien (TW); Jau-Jen Du, Taoyuan Hsien (TW); Tsai-Shen Lin, Taoyuan Hsien (TW); Yu-Chin Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 700 days.

(21) Appl. No.: 11/734,504

(22) Filed: Apr. 12, 2007

(65) Prior Publication Data

US 2007/0273465 A1 Nov. 29, 2007

(30) Foreign Application Priority Data

May 26, 2006 (TW) ..... 95118733 A

(51) Int. Cl.
*H01F 27/28* (2006.01)

(52) U.S. Cl. ..... 336/232; 336/200; 336/220

(58) Field of Classification Search ..... 336/212, 336/208, 220, 221, 222, 232, 200, 223
See application file for complete search history.

(56) References Cited

U.S. PATENT DOCUMENTS 2,888,654 A * 5/1959 Bugg ..... 336/221
5,124,870 A * 6/1992 Toyoda ..... 360/123.39
5,559,487 A * 9/1996 Butcher et al. ..... 336/178
5,684,445 A * 11/1997 Kobayashi et al. ..... 336/83
5,990,776 A * 11/1999 Jitaru ..... 336/200
6,080,271 A * 6/2000 Fujii ..... 156/345.48
6,136,458 A * 10/2000 Inoue ..... 428/848.5
6,184,488 B1 * 2/2001 Gates ..... 219/121.43
6,222,437 B1 * 4/2001 Soto et al. ..... 336/200
6,522,233 B1 * 2/2003 Kyoso et al. ..... 336/200
6,611,035 B2 * 8/2003 Inoue ..... 257/421
6,650,218 B1 * 11/2003 Fushimi ..... 336/178
6,859,130 B2 * 2/2005 Nakashima et al. ..... 336/200
6,972,657 B1 * 12/2005 Pacala et al. ..... 336/200
7,012,497 B2 * 3/2006 Steingroever ..... 336/232
7,375,609 B2 * 5/2008 Suzuki et al. ..... 336/200
7,427,910 B2 * 9/2008 Mehrotra et al. ..... 336/200
7,432,793 B2 * 10/2008 Nussbaum ..... 336/223
7,439,839 B2 * 10/2008 Podlisk et al. ..... 336/200
7,567,164 B2 * 7/2009 Chin ..... 336/198

FOREIGN PATENT DOCUMENTS

JP 2002-093634 A 3/2002

* cited by examiner

*Primary Examiner* — Anh T Mai
*Assistant Examiner* — Joselito Baisa
(74) *Attorney, Agent, or Firm* — Volpe and Koenig, P.C.

(57) ABSTRACT

A transformer includes a first electrical conductor, a second electrical conductor and a core. The second electrical conductor is electromagnetically coupled with the first electrical conductor. The second electrical conductor includes at least one multilayer spiral coil, which is formed by winding a conductive wire and has a through hole at its central portion. Both ends of the conductive wire extend outward from a periphery of the multilayer spiral coil. The core penetrates through the through hole and covers at least one portion of the first electrical conductor and the second electrical conductor.

55 Claims, 13 Drawing Sheets

72

TRANSFORMER

CROSS REFERENCE TO RELATED APPLICATIONS

This Non-provisional application claims priority under 35 U.S.C. §119(a) on Patent Application No(s). 095118733 filed in Taiwan, Republic of China on May 26, 2006, the entire contents of which are hereby incorporated by reference.

BACKGROUND OF THE INVENTION

1. Field of Invention

The invention relates to a transformer, and, in particular, to a transformer having a high current density.

2. Related Art

A transformer is an electronic assembly, which is frequently used in various electronic apparatuses. Referring to FIG. 1, a conventional transformer 1 includes a bobbin 11, a coil set 12, a pin seat 14 and a core 15. The coil set 12 includes a primary coil and a secondary coil each formed by winding a conductive wire around a winding region 111 of the bobbin 11. The primary coil is electromagnetically coupled with the secondary coil. The pin seat 14 is connected with the bobbin 11 and includes a plurality of pins 141, which is for electrically connecting with a circuit board 17. The core 15 is composed of a first core 151 and a second core 152, which are respectively fit with two ends of the bobbin 11 and are connected together to form an electromagnetic loop.

In general, the coil set is made in the form of concentrated or folded winding. The concentrated coil set 12 is directly wound around the bobbin 11, while the folded winding structure has a primary coil and a secondary coil each wound to form a wire cake 20, as shown in FIG. 2, and then the wire cakes 20 are alternately arranged along an axial direction of the bobbin 11 and then fit with the bobbin 11. The conventional wire cake 20 is a single-layer spiral wire cake formed by spirally winding a conductive wire outward on a plane, and both ends (i.e., a beginning end 20*a* and a terminating end 20*b*) of the conductive wire are suspended outside the structure of the wire cake 20. The beginning end 20*a* of the conductive wire turns from inside and thus extends outside the structure of the wire cake 20 so that the beginning end 20*a* may be electrically connected with a pin or connected to a power source. However, under large capacity and high current requirements, the number of turns of the coil of transformer 1 is typically increased. However, the beginning end 20*a* of the wire has to turn outward from the inner diameter of the wire cake 20 due to the conventional winding method of the single-layer spiral wire cake. Thus, when plural wire cake structures are connected in series, a gap exists between the wire cakes due to the width of the conductive wire. The existence of the gap tends to reduce the extent of coupling between the windings.

Therefore, it is an important subject to provide a transformer having a high extent of coupling between the windings and high current density.

SUMMARY OF THE INVENTION

In view of the foregoing, the invention is to provide a transformer having a high extent of coupling between windings, a high current density, and enhanced efficiency.

To achieve the above, a transformer according to the invention includes a first electrical conductor, a second electrical conductor and a core. The second electrical conductor is electromagnetically coupled with the first electrical conductor. The second electrical conductor includes at least one multilayer spiral coil, which is formed by winding a conductive wire and has a through hole at its central portion. Both ends of the conductive wire extend outward from a periphery of the multilayer spiral coil. The core penetrates through the through hole and covers at least one portion of the first electrical conductor and the second electrical conductor.

To achieve the above, the invention also discloses a transformer, which includes an electrical conductor assembly and a core. The core includes a projecting tube portion at a middle of the core, and the electrical conductor assembly is fit with the projecting tube portion. The electrical conductor assembly includes a first electrical conductor and a second electrical conductor electromagnetically coupled with the first electrical conductor. The first electrical conductor has a first through hole at a central portion of the first electrical conductor. The second electrical conductor includes at least one multilayer spiral coil, which is formed by winding a conductive wire and has a second through hole at a central portion of the multilayer spiral coil. Both ends of the conductive wire extend outward from a periphery of the multilayer spiral coil. When the projecting tube portion penetrates through the first through hole and the second through hole, the core covers at least one portion of the first electrical conductor and the second electrical conductor.

The transformer of the invention is for modulating voltage or current of a power source. The first electrical conductor may include at least a single-layer spiral coil or at least a multilayer spiral coil. Otherwise, the first electrical conductor may include at least one conductive sheet disposed between the multilayer spiral coils. The spiral coils, including the single-layer and multilayer spiral coils, are connected in series with two ends exposed out of the core.

The conductive sheet is made of copper. The conductive sheet may be ring-shaped and have a first through hole at a central portion of the conductive sheet. Alternatively, the conductive sheet is U-shaped and has two ends exposed outside the core for electrically connecting to a circuit board or an external member. Otherwise, the first electrical conductor may include a plurality of conductive sheets, and the conductive sheets are formed as individual parts or are integrally formed as a single piece with a turning portion connecting the conductive sheets together. The conductive wire is an enameled wire, a triple insulated wire or a self-adhesive wire. The multilayer spiral coil is adhered by an adhesive agent between layers and spirals. The multilayer spiral coil preferably has an even number of winding layers. The core includes a first core and a second core opposite to the first core, and the first core and the second core are fit with the through hole. The core is an EE-type core, an EI-type core, a RM-type core, an E-type core, a PQ-type core, an C-type core, an ETD-type core, or a core with any other shape.

As mentioned above, the transformer of the invention has the single conductive wire that is spirally wound to form a multilayer spiral coil to serve as the primary coil or the secondary coil of the transformer and two ends of the conductive wire extend outward from the periphery of the multilayer spiral coil. That is, the beginning end and the terminating end of the wound conductive wire are located on the outer periphery of the multilayer spiral coil, so the layers in the structure of the multilayer spiral coil are combined together tightly. Compared with the prior art, a higher extent of coupling exists between the windings of the invention, and a higher current density may be obtained from windings of the same size so that the efficiency of the transformer can be enhanced.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
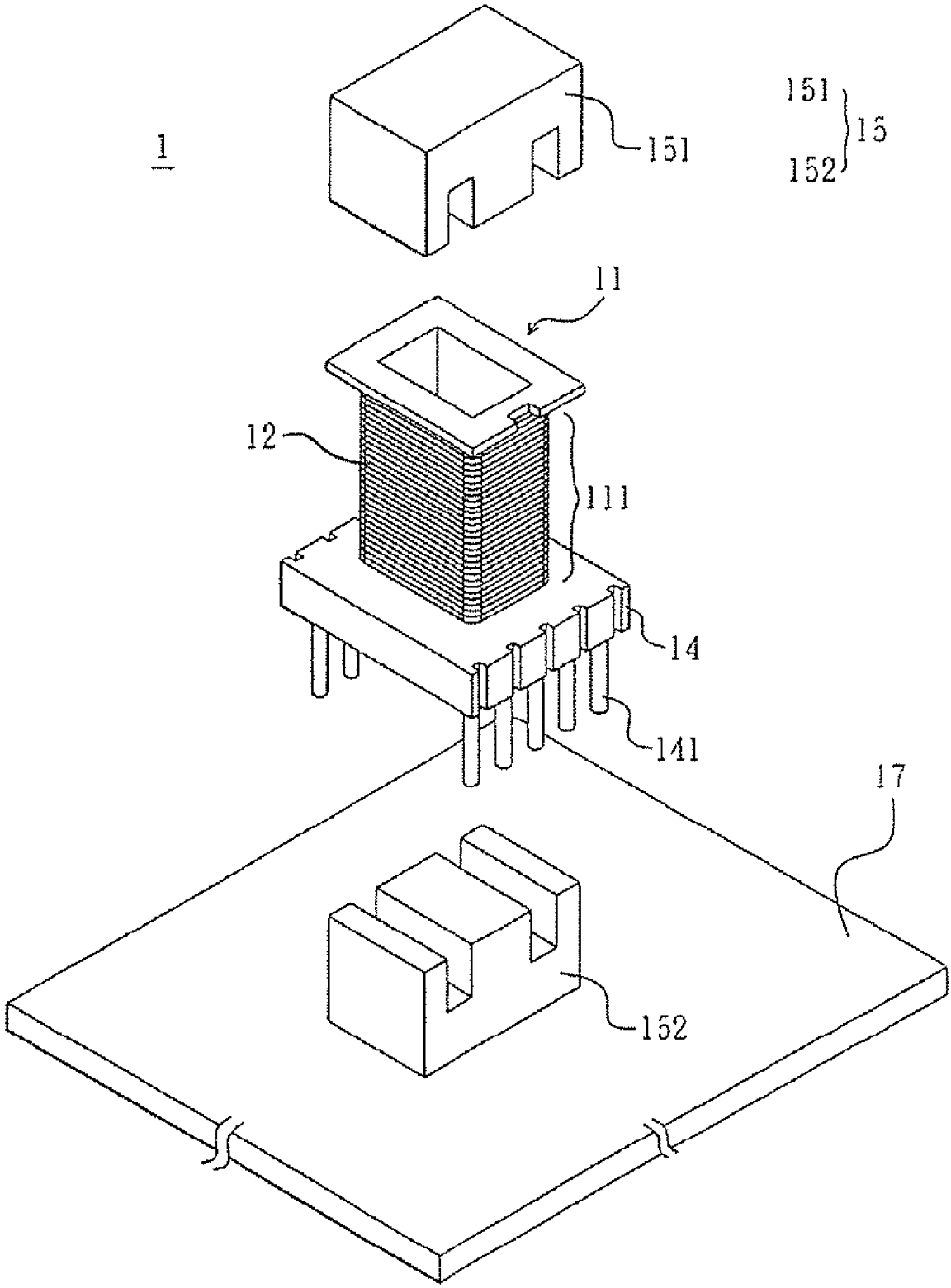
FIG. 1(PRIOR ART)
FIG. 1 is a schematic illustration showing a conventional transformer.
Figure 2:
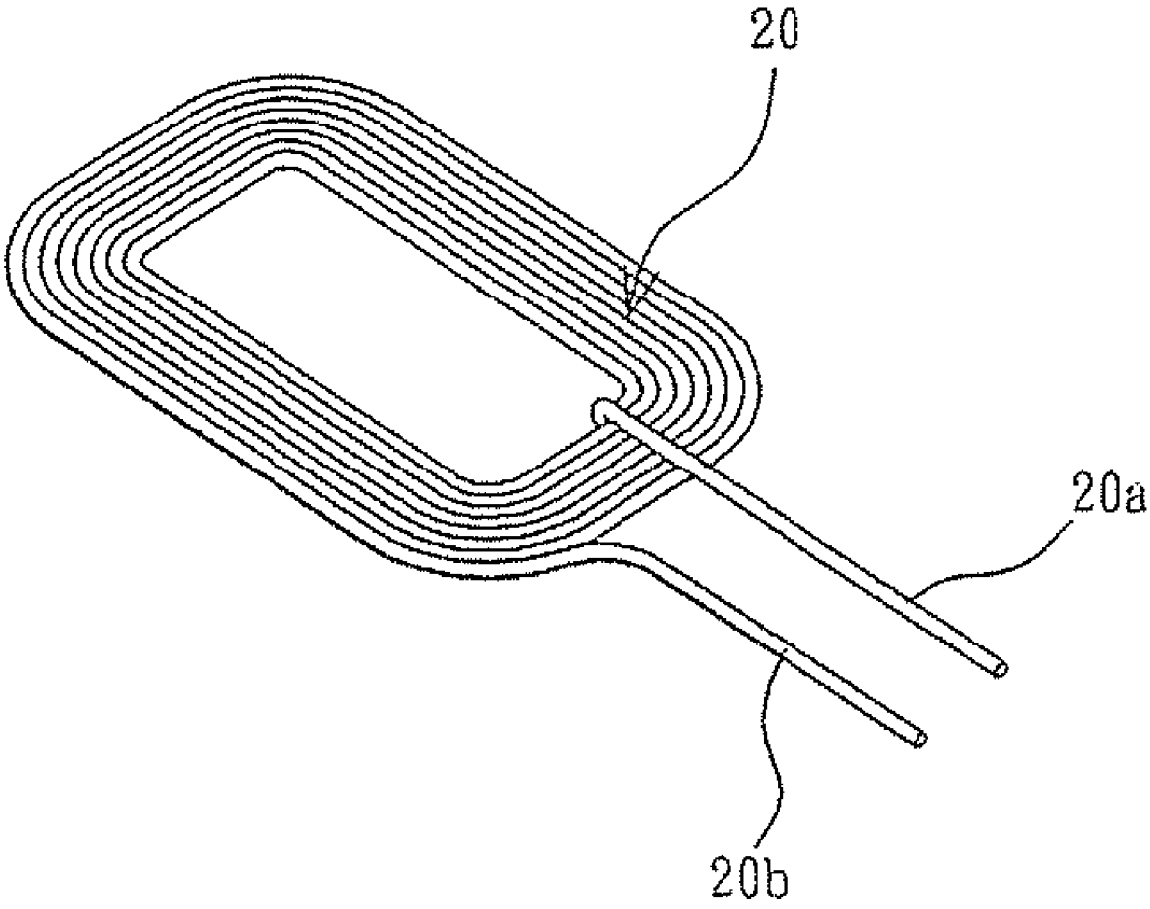
FIG. 2(PRIOR ART)
FIG. 2 is a schematic illustration showing a conventional single-layer spiral wire cake.
Figure 3A:
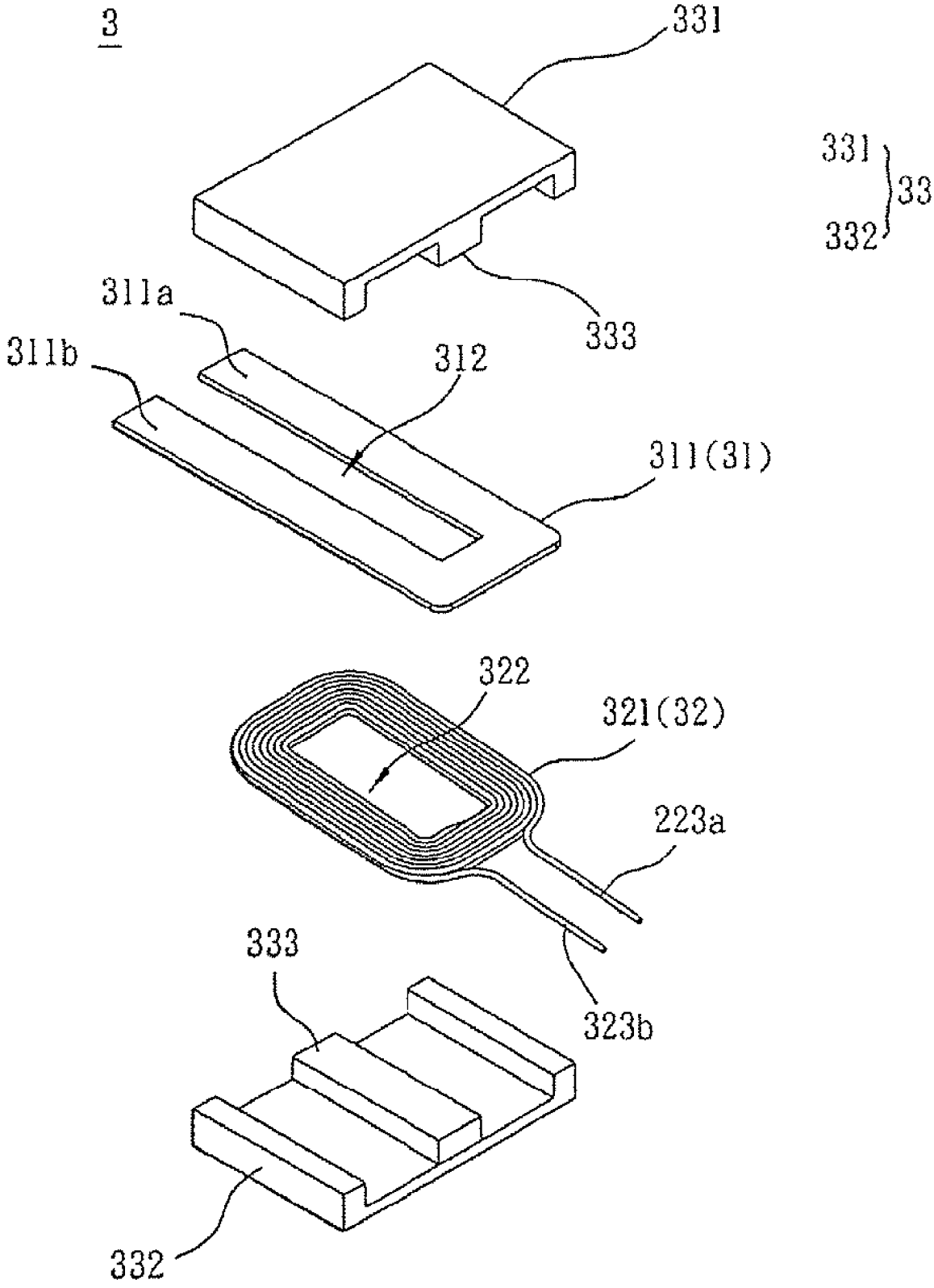
FIGS. 3A and 3B are schematic illustrations showing a transformer according to a preferred embodiment of the invention.
Figure 3B:
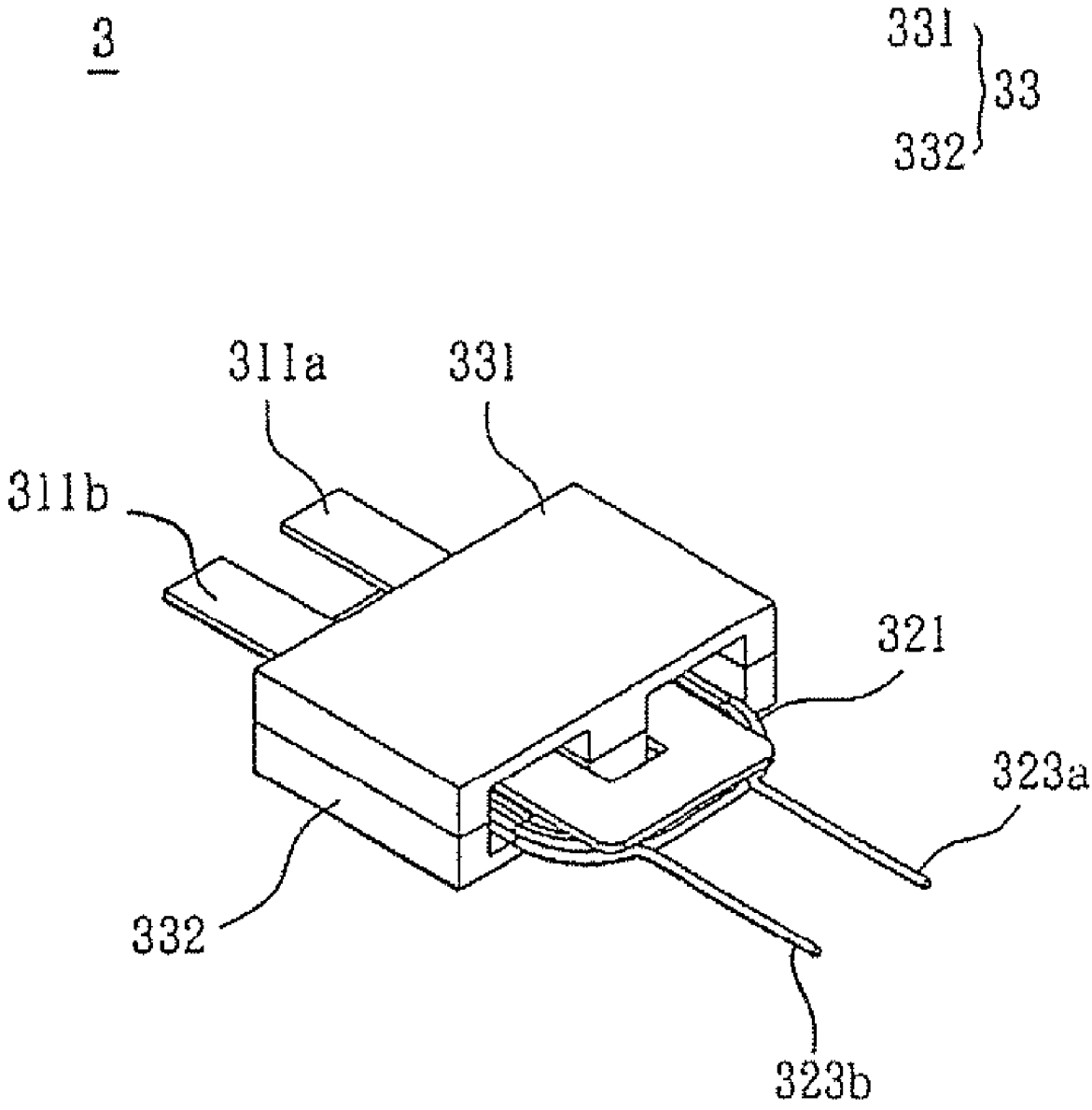

FIGS. 3A and 3B are schematic illustrations showing a transformer according to a preferred embodiment of the invention. Referring to FIGS. 3A and 3B, a transformer 3 according to a preferred embodiment of the invention includes a first electrical conductor 31, a second electrical conductor 32 and a core 33. The transformer 3 of this embodiment can be used to modulate a voltage or a current of a power source.

The first electrical conductor 31 includes at least one conductive sheet 311, the second electrical conductor 32 includes at least one multilayer spiral coil 321, and the first electrical conductor 31 is electromagnetically coupled with the second electrical conductor 32. In this embodiment, the conductive sheet 311 may be a copper sheet.

The multilayer spiral coil 321 is formed by winding a conductive material, such as a conductive wire. According to the actual requirement, the conductive wire is spirally wound by a specific number of loops and has a through hole 322 at a central portion of the multilayer spiral coil 321. Both ends 323*a* and 323*b* of the conductive wire extend outward from a periphery of the multilayer spiral coil 321. That is, the beginning end 323*a* and the terminating end 323*b* of the wound conductive wire are located on the outer periphery of the multilayer spiral coil 321, and serve as pins. In this embodiment, the multilayer spiral coil 321 has, without limitation to, a dual-layer wire cake structure. The multilayer spiral coil 321 may also have a multilayer wire cake structure formed by winding the conductive wire preferably by an even number of layers.

In this embodiment, the conductive wire, such as an enameled wire, a triple insulated wire or a self-adhesive wire, is composed of a wire and an insulation material covering the wire. In order to give the multilayer spiral coil 321 a dense structure, the layers and spirals of multilayer spiral coil 321 are adhered together by an adhesive agent. In addition, the conductive wire itself may also be adhesive to prevent the wound coil from loosening.

In this embodiment, the core 33 is made of a magnetic material and includes a first core 331 and a second core 332 each having a protrusion 333. The protrusions 333 penetrate through the through hole 322 of the multilayer spiral coil 321 and an opening 312 of the conductive sheet 311 to form the transformer 3 of this embodiment. The core 33 covers at least one portion of the first electrical conductor 31 and the second electrical conductor 32, as shown in FIG. 3B. Herein, the first core 331 and the second core 332 are connected with and facing each other to form an electromagnetic loop so that the first electrical conductor 31 is electromagnetically coupled with the second electrical conductor 32.

The conductive sheet 311 may have, for example, a U-shape. After the first core 331 and the second core 332 are assembled together, both ends 311*a* and 311*b* of the conductive sheet 311 are exposed outside the core 33 and are to be electrically connected with a circuit board or an external member (not shown). Also, the both ends 323*a* and 323*b* of the multilayer spiral coil 321 are also electrically connected with the circuit board or the external member. Furthermore, in this embodiment, the core 33 may be an EE-type core, an EI-type core, a RM-type core, an E-type core, a PQ-type core, an EC-type core, an ETD-type core, or a core with any other shape.

Figure 4:
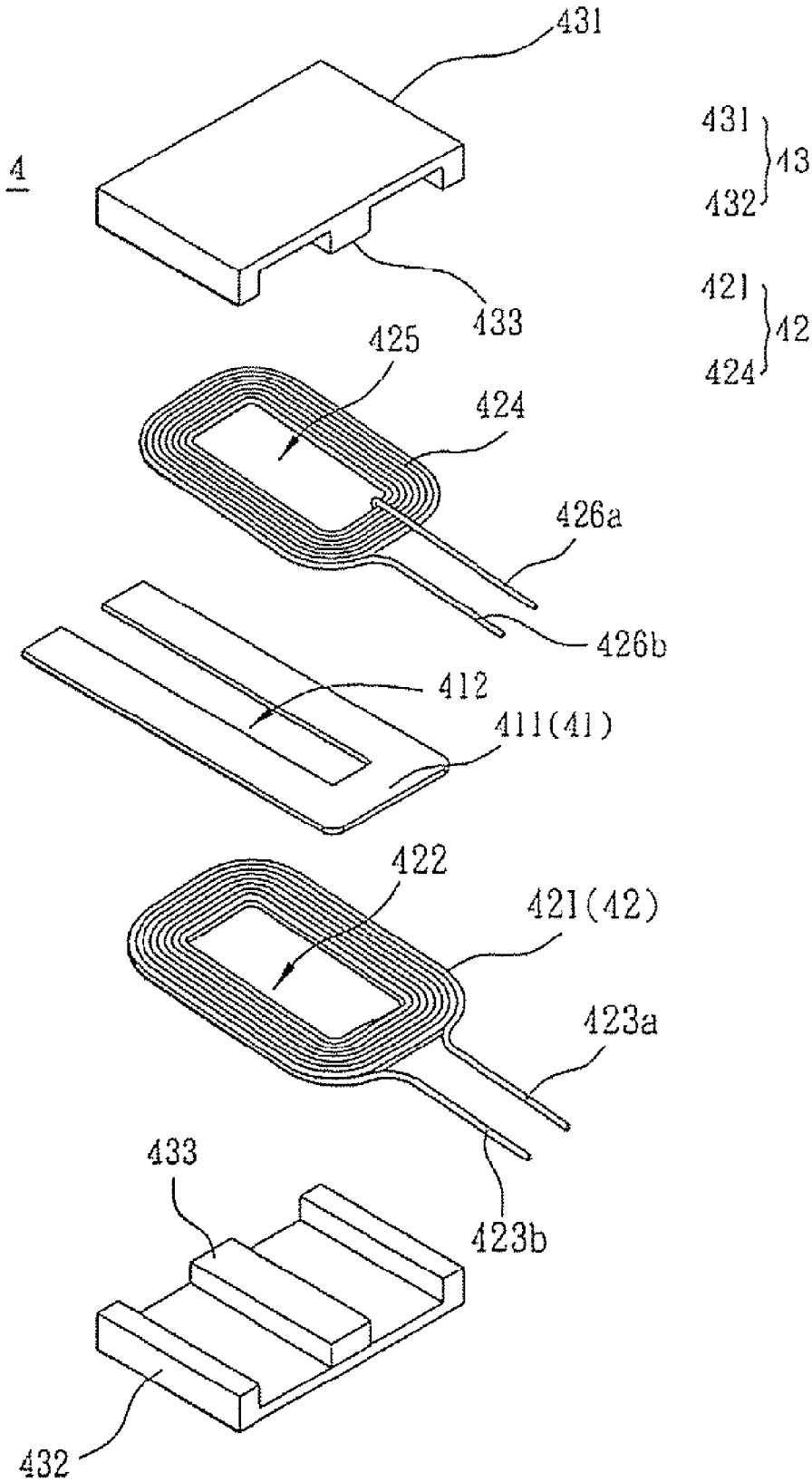
FIG. 4 is a schematic illustration showing another transformer according to the preferred embodiment of the invention.

Alternatively, the transformer of this invention may be composed of a single conductive sheet and a single multilayer spiral coil, or be composed of a single conductive sheet, a single multilayer spiral coil and a single-layer spiral coil. FIG. 4 is a schematic illustration showing another transformer according to the preferred embodiment of the invention. Referring to FIG. 4, a transformer 4 includes a first electrical conductor 41, a second electrical conductor 42 and a core 43.

The first electrical conductor 41 includes at least one conductive sheet 411. The second electrical conductor 42 includes a multilayer spiral coil 421 and further includes a single-layer spiral coil 424 electrically connected with the multilayer spiral coil 421. The first electrical conductor 41 is electromagnetically coupled with the second electrical conductor 42. Herein, the conductive sheet 411 of the first electrical conductor 41 is disposed between the single-layer spiral coil 424 and the multilayer spiral coil 421. In this embodiment, the single-layer spiral coil 424 may also be formed by winding a conductive wire in a spiral pattern. For example, a beginning end 426*a* of the conductive wire, such as an enameled wire, a triple insulated wire or a self-adhesive wire, is spirally wound outward on a plane, and turns from the inside and extends outside the structure of the single-layer spiral coil 424 to form a single-layer spiral wire cake. Both ends (i.e., the beginning end 426*a* and a terminating end 426*b*) of the conductive wire are suspended outside the structure of the single-layer spiral coil 424, and a beginning end 423*a* and a terminating end 423*b* of the multilayer spiral coil 421 are also suspended outside the structure of the multilayer spiral coil 421. Thus, both ends of each of the single-layer spiral coil 424 and the multilayer spiral coil 421 may serve as pins to be electrically connected with an external member, a circuit board or a power source.

The core 43 is made of a magnetic material and includes a first core 431 and a second core 432 each having a protrusion 433. The protrusions 433 face each other and penetrate through a through hole 425 of the single-layer spiral coil 424, an opening 412 of the conductive sheet 411 and a through hole 422 of the multilayer spiral coil 421 to form the transformer 4 of this embodiment.

Figure 5A:
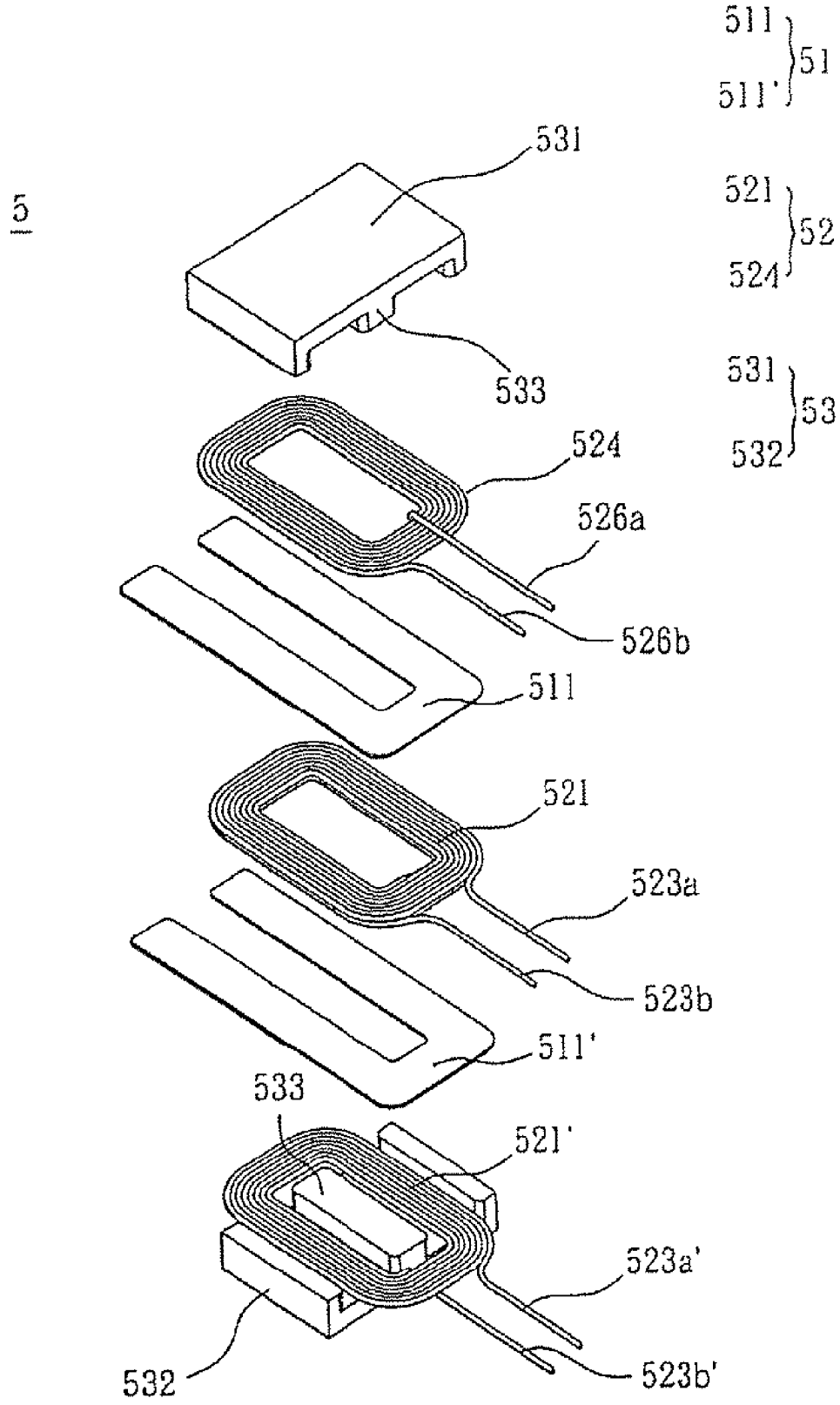
FIGS. 5A and 5B are schematic illustrations showing still another transformer according to the preferred embodiment of the invention.
Figure 5B:
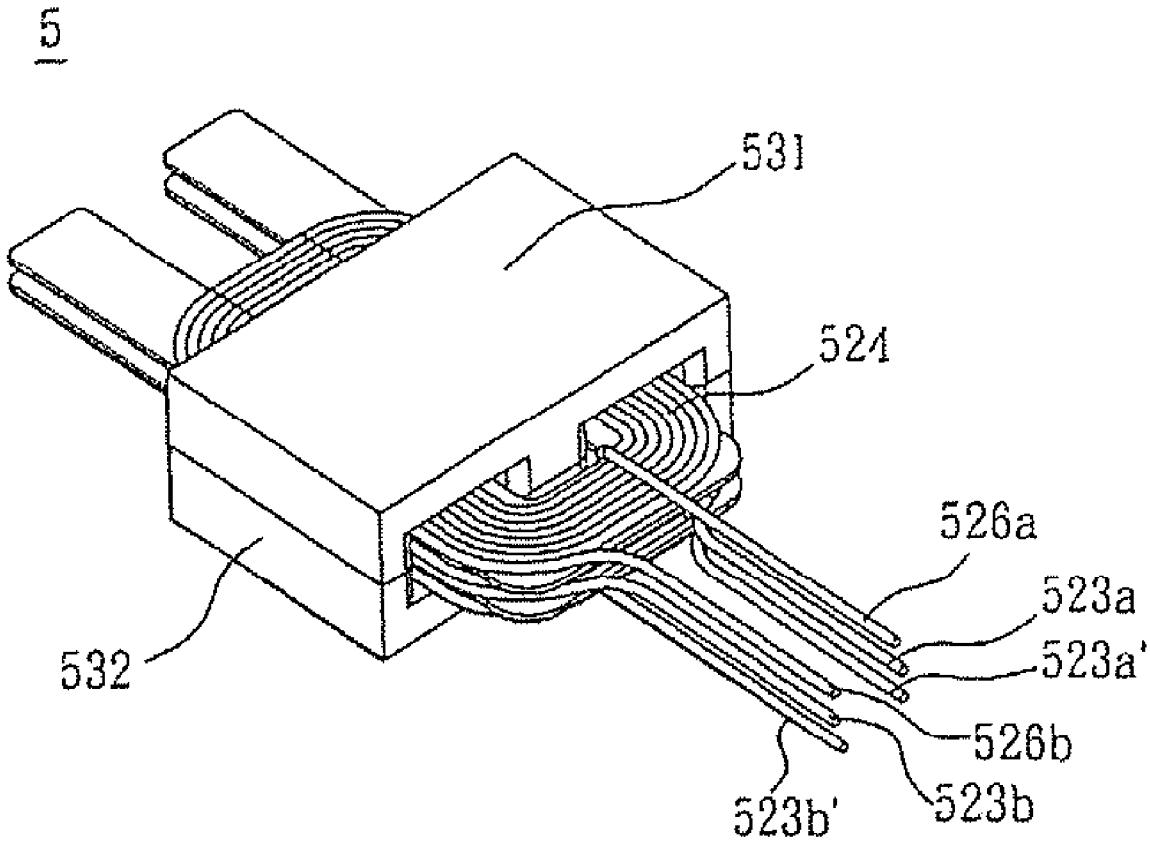

Alternatively, the transformer of this invention may be composed of a single conductive sheet and a single multilayer spiral coil, and further may be composed of multiple conductive sheets, two multilayer spiral coils and one single-layer spiral coil. FIGS. 5A and 5B are schematic illustrations showing still another transformer according to the preferred embodiment of the invention. Referring to FIGS. 5A and 5B, a transformer 5 includes a first electrical conductor 51, a second electrical conductor 52 and a core 53.

The first electrical conductor 51 includes conductive sheets 511 and 511. The second electrical conductor 52 includes a multilayer spiral coil 521 and further includes a single-layer spiral coil 524 and a multilayer spiral coil 521 electrically connected with each other. The first electrical conductor 51 is electromagnetically coupled with the second electrical conductor 52. Herein, the conductive sheet 511 is disposed between the single-layer spiral coil 524 and the multilayer spiral coil 521, and the conductive sheet 511' is disposed between the multilayer spiral coil 521 and the multilayer spiral coil 521'.

The core 53 is made of a magnetic material and includes a first core 531 and a second core 532 each having a protrusion 533. The protrusions 533 face each other and penetrate through a through hole of the single-layer spiral coil 524, an opening of the conductive sheet 511, a through hole of the multilayer spiral coil 521, an opening of the conductive sheet 511', and a through hole 522 of the multilayer spiral coil 521' to form the transformer 5 of this embodiment, as shown in FIG. 5B.

A beginning end 526*a* and a terminating end 526*b* of the single-layer spiral coil 524 are suspended outside the transformer 5. A beginning end 523*a* and a terminating end 523*b* of the multilayer spiral coil 521 are also suspended outside the transformer 5. A beginning end 523*a*' and a terminating end 523*b*' of the multilayer spiral coil 521' are also suspended outside the transformer 5. Thus, the two ends of each of the single-layer spiral coil 524 and the multilayer spiral coils 521 and 521' may serve as pins to be electrically connected with an external member, a circuit board or a power.

Figure 6A:
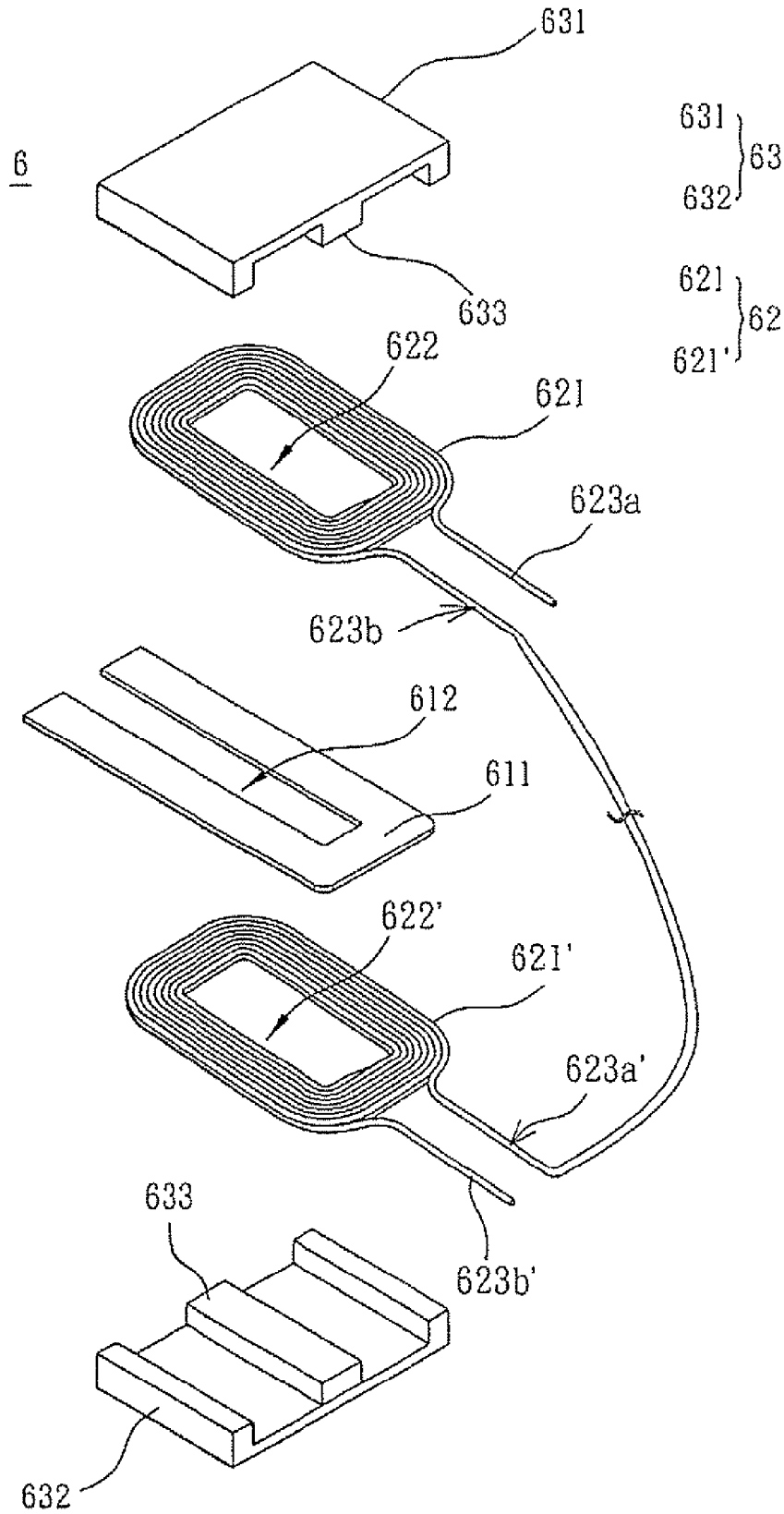
FIGS. 6A and 6B are schematic illustrations showing yet still another transformer according to the preferred embodiment of the invention.
Figure 6B:
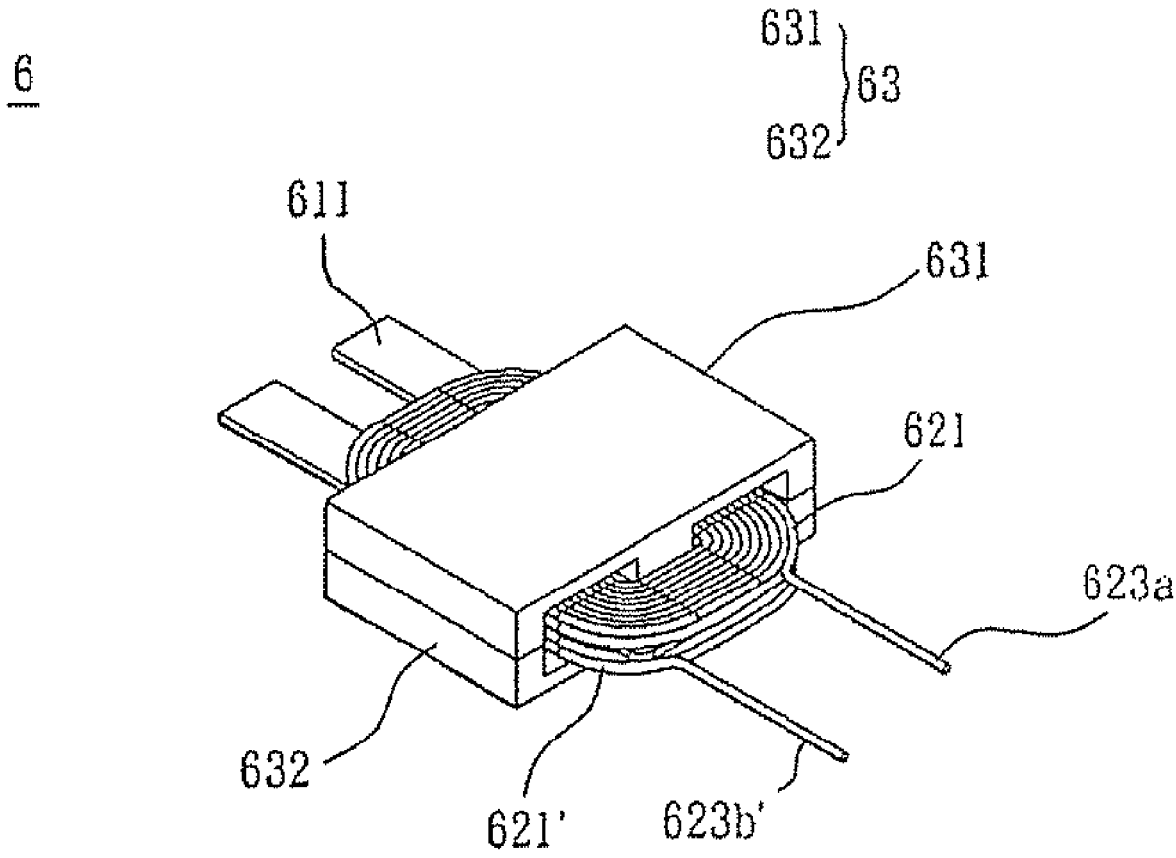

In addition, the transformer of the invention may be composed of a single conductive sheet and a single multilayer spiral coil, and may further be composed oral single conductive sheet and two multilayer spiral coils. FIGS. 6A and 6B are schematic illustrations showing yet still another transformer according to the preferred embodiment of the invention. Referring to FIGS. 6A and 6B, a transformer 6 includes a first electrical conductor 61, a second electrical conductor 62 and a core 63.

The first electrical conductor 61 includes a conductive sheet 611. The second electrical conductor 62 includes a plurality of multilayer spiral coils, such as a multilayer spiral coil 621 and a multilayer spiral coil 621' electrically connected with each other. The first electrical conductor 61 is electromagnetically coupled with the second electrical conductor 62. Herein, the conductive sheet 611 is disposed between the multilayer spiral coil 621 and the multilayer spiral coil 621'.

The core 63 is made of a magnetic material and includes a first core 631 and a second core 632 each having a protrusion 633. The protrusions 633 face each other and penetrate through a through hole 622 of the multilayer spiral coil 621, an opening 612 of the conductive sheet 611 and a through hole 622' of the multilayer spiral coil 621' to form the transformer 6 of this embodiment, as shown in FIG. 6B.

According to different requirements, ends 623*a*, 623*a*', 623*b* and 623*b*' of the conductive wires of the multilayer spiral coils 621 and 621' may extend outward from a periphery of the multilayer spiral coil, or the conductive wires of the multilayer spiral coils 621 and 621' may be connected in series. For example, the terminating end 623*b* of the multilayer spiral coil 621 and the beginning end 623*a*' of the multilayer spiral coil 621' may be connected together, and the ends 623*a* and 623*b*' of the multilayer spiral coils 621 and 621' are exposed outside the core 63, as shown in FIG. 6B. Thus, after the transformer 6 is assembled, only the beginning end 623*a* of the multilayer spiral coil 621 and the terminating end 623*b*' of the multilayer spiral coil 621' serve as pins to be electrically connected with an external member, a circuit board or a power source. Consequently, the procedures of subsequently electrically connecting the pins to the circuit board or the external member may be simplified due to the reduced number of pins.

Figure 7A:
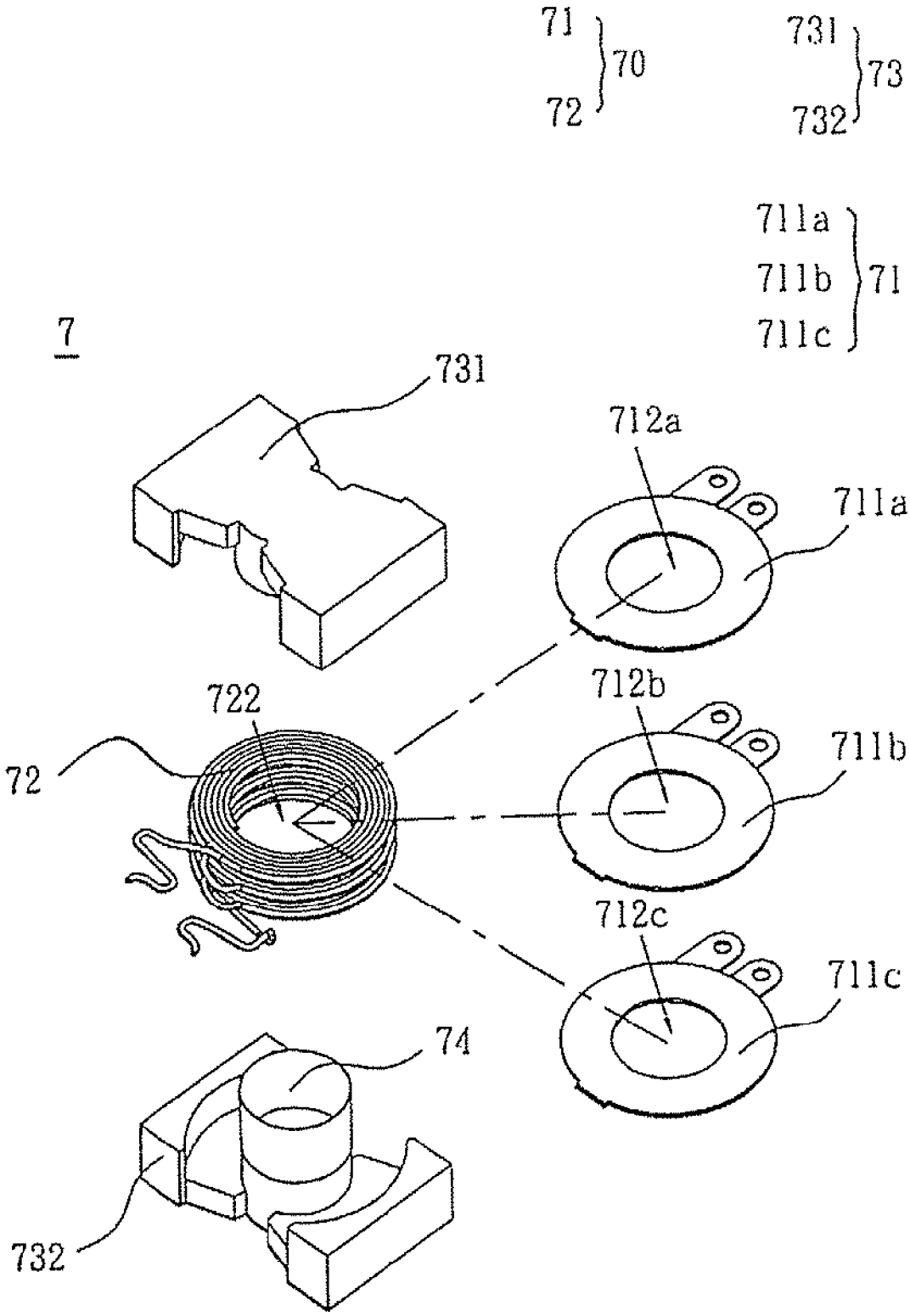
FIG. 7A is a schematic illustration showing yet still another transformer according to the preferred embodiment of the invention.

FIG. 7A is a schematic illustration showing yet still another transformer according to the preferred embodiment of the invention. Referring to FIG. 7A, a transformer 7 includes an electrical conductor assembly 70 and a core 73. The core 73 is preferably composed by two cores 731 and 732 arranged in the vertical direction. In addition, the lower core 732 includes a projecting tube portion 74 at its middle and the electrical conductor assembly 70 is fit with the projecting tube portion 74. The electrical conductor assembly 70 includes a first electrical conductor 71 and a second electrical conductor 72, which are alternately fit with the projecting tube portion 74.

Figure 7B:
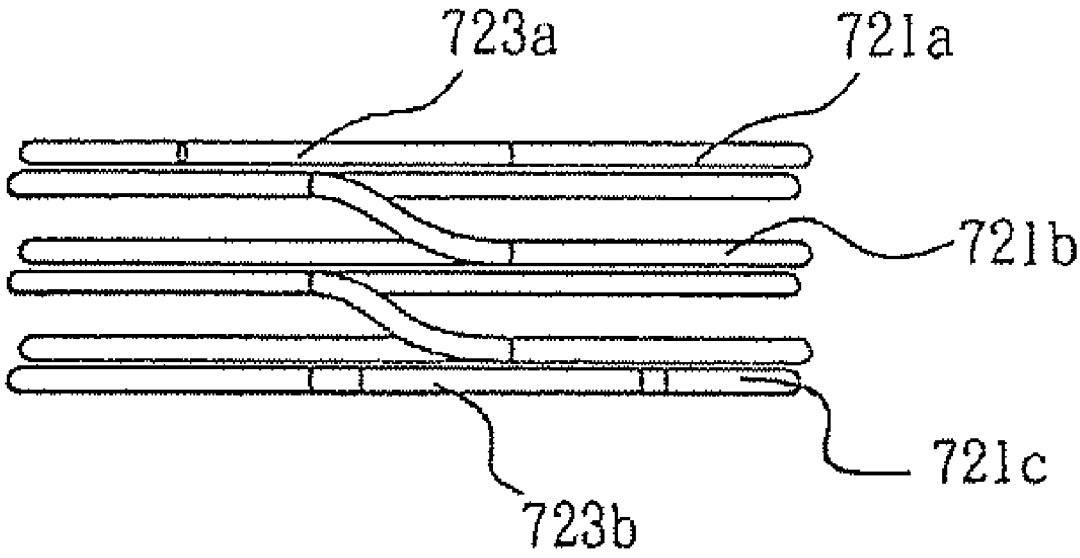
FIG. 7B is a side view showing a multilayer spiral coil of FIG. 7A.

The first electrical conductor 71 includes one conductive sheet or multiple sheets, such as conductive sheets 711*a*, 711*b* and 711*c*. The conductive sheets 711*a*, 711*b* and 711*c* all have a ring shape and have first through holes 712*a*, 712*b* and 712*c* respectively at the central portions thereof. The second electrical conductor 72 includes one multilayer spiral coil or multiple multilayer spiral coils, such as multilayer spiral coils 721*a*, 721*b* and 721*c*, each of which is formed by winding a conductive wire and has a second through hole 722 at its central portion. Both ends of the conductive wire extend outward from a periphery (i.e., the beginning end 723*a* of the multilayer spiral coil 721*a* and the terminating end 723*b* of the multilayer spiral coil 721*c*) of the multilayer spiral coil, as shown in FIG. 7B.

The conductive sheets 711*a*, 711*b* and 711*c* are respectively disposed between the multilayer spiral coils 721*a*, 721*b* and 721*c*. The first electrical conductor 71 and the second electrical conductor 72 are fit with the projecting tube portion 74 through the first through holes 712*a*, 712*b* and 712*c* and the second through hole 722, and the first electrical conductor 71 is electromagnetically coupled with the second electrical conductor 72. When the projecting tube portion 74 penetrates through the first through hole of the first electrical conductor 71 and the second through hole of the second electrical conductor 72, the upper and lower cores 731 and 732 cover at least one portion of the first electrical conductor 71 and the second electrical conductor 72 to form the transformer 7 of this embodiment.

Because the arrangements, the structural features, the materials and the winding methods of the conductive wires in this transformer are similar to those of the transformers mentioned hereinabove, detailed descriptions thereof will be omitted.

Figure 8A:
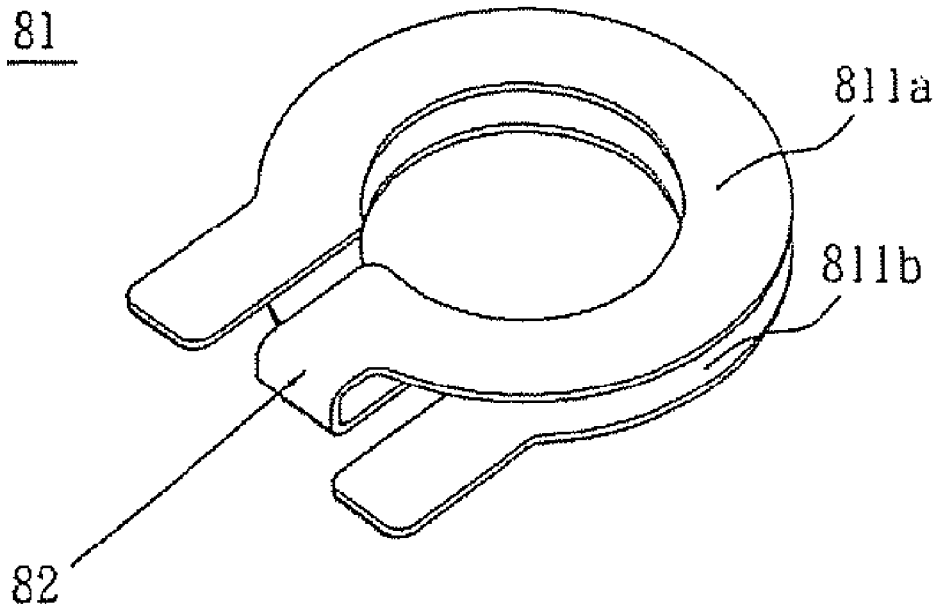
FIG. 8A is a schematic illustration showing a conductive sheet in FIG. 7A according to another embodiment of the invention.
Figure 8B:
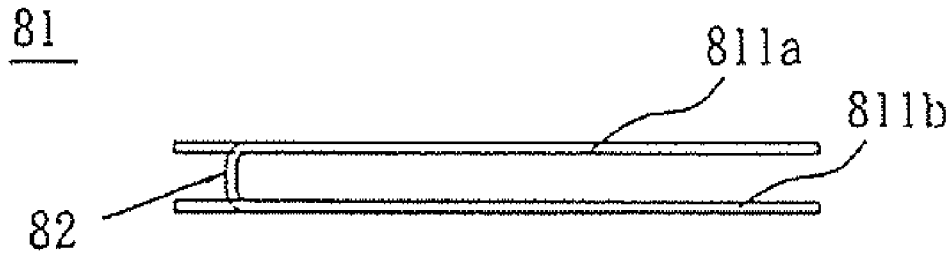
FIG. 8B is a side view showing the conductive sheet of FIG. 8A.

In addition, the conductive sheets 711*a*, 711*b* and 711*c* of the first electrical conductor 71 may be formed as different parts or be integrally formed into a single structure. FIG. 8A is a schematic illustration showing a conductive sheet in FIG. 7A according to another embodiment of the invention. FIG. 8B is a side view showing the conductive sheet of FIG. 8A. As shown in FIGS. 8A and 8B, a first electrical conductor 81 is composed of conductive sheets 811*a* and 811*b*, and a turning portion 82 is for connecting the conductive sheets 811*a* and 811*b* together so that the first electrical conductor 81 has an integrally formed structure.

Figure 9:
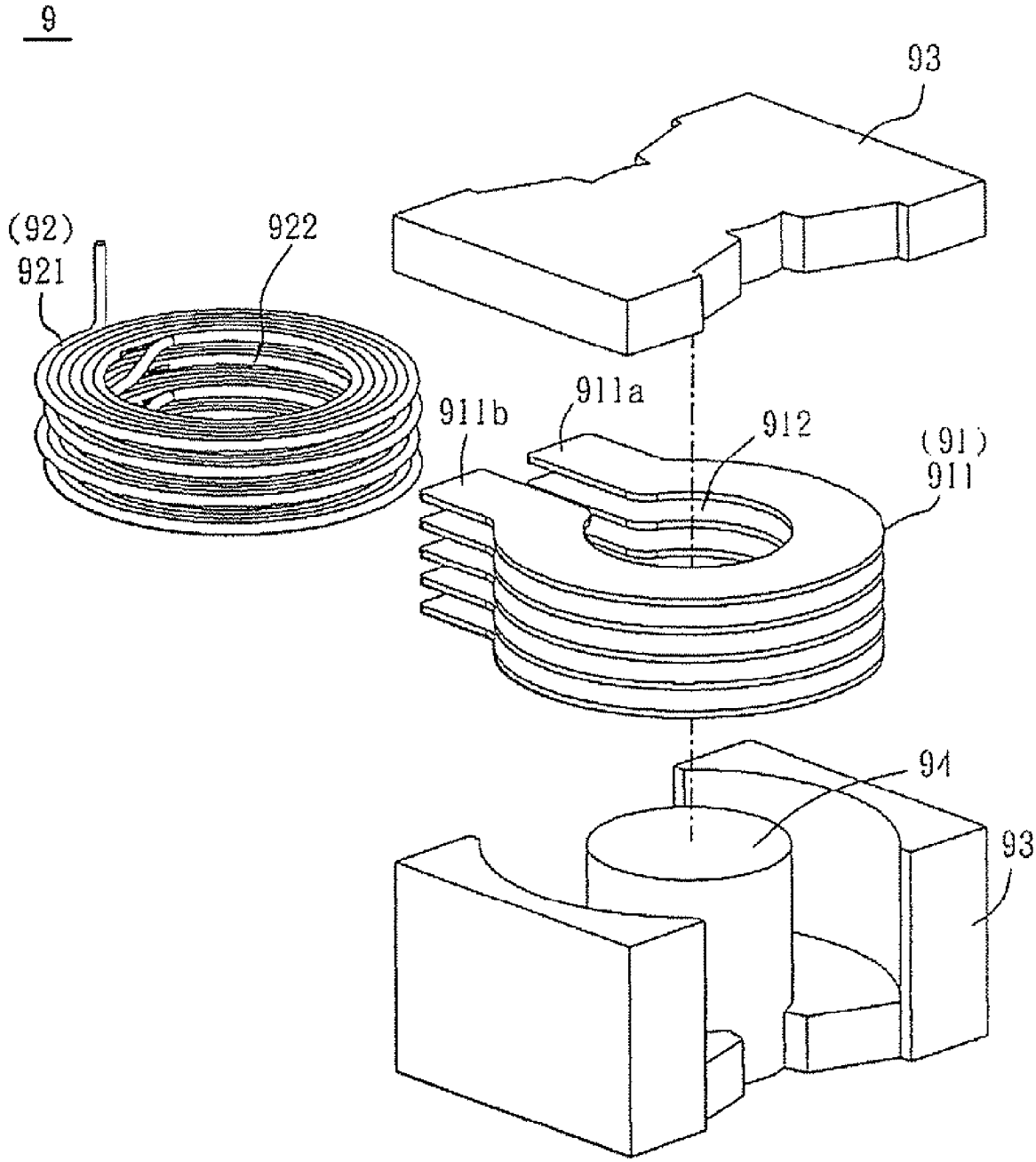
FIG. 9 is a schematic illustration showing yet still another transformer according to the embodiment of the invention

FIG. 9 is a schematic illustration showing yet still another transformer 9 according to the embodiment of the invention. Referring to FIG. 9, the most structures and functions of the transformer 9 are the same as those of the above-mentioned transformer 7. The differences between the transformer 9 and the transformer 7 will be described hereinbelow. A first electrical conductor 91 of the transformer 9 includes a plurality of conductive sheets 911. Each conductive sheet 911 is ring-shaped and has two ends 911*a* and 911*b* that are not connected with each other. In addition, a second electrical conductor 92 includes a plurality of multilayer spiral coils 921, which can be formed by winding a conductive wire. The conductive sheets 911 are individually disposed between the multilayer spiral coils 921. The projecting tube portion 94 of the core 93 passes through the through hole 912 of the first electrical conductor 91 and the through hole 922 of the second electrical conductor 92. Accordingly, the transformer 9 is thus assembled.

In the assembled transformer 9, the ends 911*a* and 911*b* of the conductive sheets 911 can protrude out of the core 93, so that they can be used as the pins for connecting external components, circuit board or power source. In this embodiment, the transformer 9 is lain on the connected object, which is differ from the above-mentioned transformer that is stood on the connected object.

In summary, the transformer according to the invention has the single conductive wire that is spirally wound to form a multilayer spiral coil to serve as the primary coil or the secondary coil of the transformer and two ends of the conductive wire extend outward from the periphery of the multilayer spiral coil. That is, the beginning end and the terminating end of the wound conductive wire are located on the outer periphery of the multilayer spiral coil, so the layers in the structure of the multilayer spiral coil are combined together tightly. Compared with the prior art, there is a higher extent of coupling between the windings of the invention, and a higher current density may be obtained with windings of the same size, so that the efficiency of the transformer can be enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A transformer comprising:

a first electrical conductor;

a second electrical conductor electromagnetically coupled with the first electrical conductor and comprising at least one multilayer spiral coil having at least two winding layers physically combined together, wherein the multilayer spiral coil is formed by spirally winding a conductive wire and both ends of the conductive wire extend outward from the outer periphery of the multilayer spiral coil, and the at least two winding layers of the multilayer spiral coil are adhered together by an adhesive agent between the winding layers; and a core penetrating through the through hole and covering at least one portion of the first electrical conductor and the second electrical conductor.

2. The transformer according to claim 1, wherein the second electrical conductor comprises a plurality of multilayer spiral coils, and the multilayer spiral coils are electrically connected together.

3. The transformer according to claim 2, wherein the multilayer spiral coils are connected in series with two ends exposed outside the core.

4. The transformer according to claim 1, wherein the first electrical conductor comprises at least a single-layer spiral coil or at least a multilayer spiral coil.

5. The transformer according to claim 4, wherein the single-layer and the multilayer spiral coil are connected in series with two ends exposed outside the core.

6. The transformer according to claim 1, wherein the first electrical conductor comprises at least one conductive sheet.

7. The transformer according to claim 6, wherein the conductive sheet is made of copper.

8. The transformer according to claim 6, wherein the conductive sheet is ring-shaped and has a first through hole at a central portion of the conductive sheet.

9. The transformer according to claim 6, wherein the conductive sheet is U-shaped and has two ends exposed outside the core for electrically connecting to a circuit board or an external member.

10. The transformer according to claim 1, wherein the first electrical conductor comprises a plurality of conductive sheets, and the conductive sheets are formed as individual parts.

11. The transformer according to claim 1, wherein the first electrical conductor comprises a plurality of conductive sheets, and the conductive sheets are integrally formed as a single piece.

12. The transformer according to claim 11, wherein the first electrical conductor further comprises a turning portion for connecting the conductive sheets together, and the conductive sheets are integrally formed as a single piece.

13. The transformer according to claim 1, wherein the second electrical conductor further comprises a single-layer spiral coil electrically connected with the multilayer spiral coil.

14. The transformer according to claim 13, wherein the single-layer and the multilayer spiral coil are connected in series with two ends exposed out of the core.

15. The transformer according to claim 13, wherein the first electrical conductor comprises at least one conductive sheet disposed between the single-layer spiral coil and the multilayer spiral coil.

16. The transformer according to claim 15, wherein the conductive sheet is made of copper.

17. The transformer according to claim 15, wherein the conductive sheet is ring-shaped and has a first through hole at a central portion of the conductive sheet.

18. The transformer according to claim 15, wherein the conductive sheet is U-shaped and has two ends exposed out of the core for electrically connecting to a circuit board or an external member.

19. The transformer according to claim 1, wherein the first electrical conductor comprises a plurality of conductive sheets, and the conductive sheets are formed as individual parts.

20. The transformer according to claim 1, wherein the first electrical conductor comprises a plurality of conductive sheets, and the conductive sheets are integrally formed as a single piece.

21. The transformer according to claim 20, wherein the first electrical conductor further comprises a turning portion for connecting the conductive sheets together, and the conductive sheets are integrally formed as a single piece.

22. The transformer according to claim 1, wherein the conductive wire is an enameled wire, a triple insulated wire or a self-adhesive wire.

23. The transformer according to claim 1, wherein the multilayer spiral coil has an even number of winding layers.

24. The transformer according to claim 1, wherein the core comprises a projecting tube portion at a middle of the core, and the projecting tube portion is for penetrating through the through hole.

25. The transformer according to claim 1, wherein the core comprises a first core and a second core opposite to the first core, and the first core and the second core are fit with the through hole.

26. The transformer according to claim 25, wherein the first core and the second core are assembled in a vertical direction to form the core, the second core comprises a projecting tube portion at a middle of the second core, and the projecting tube portion is for penetrating through the through hole.

27. The transformer according to claim 25, wherein the core is an EE-type core, an EI-type core, a RM-type core, an E-type core, a PQ-type core, an EC-type core, an ETD-type core, or a core with any other shape.

28. The transformer according to claim 1, wherein the transformer is for modulating a voltage or a current of a power source.

29. The transformer according to claim 1, wherein the at least two winding layers of the multilayer spiral coil are adhered together by an adhesive agent.

30. A transformer comprising:

a core comprising a projecting tube portion at a middle of the core; and an electrical conductor assembly fit with the projecting tube portion, the electrical conductor assembly comprising a first electrical conductor and a second electrical conductor electromagnetically coupled with the first electrical conductor, the first electrical conductor having a first through hole at a central portion of the first electrical conductor, the second electrical conductor comprising at least one multilayer spiral coil having at least two winding layers directly and physically contacting with each other, which is formed by spirally winding a conductive wire and has a second through hole at a central portion of the multilayer spiral coil, both ends of the conductive wire extending outward from the outer periphery of the multilayer spiral coil, the at least two winding layers of the multilayer spiral coil adhered together by an adhesive agent between the winding layers, wherein when the projecting tube portion penetrates through the first through hole and the second through hole, the core covers at least one portion of the first electrical conductor and the second electrical conductor.

31. The transformer according to claim 30, wherein the second electrical conductor comprises a plurality of multilayer spiral coils, and the multilayer spiral coils are electrically connected together.

32. The transformer according to claim 31, wherein the multilayer spiral coils are connected in series with two ends exposed out of the core.

33. The transformer according to claim 30, wherein the first electrical conductor comprises at least a single-layer spiral coil or at least a multilayer spiral coil.

34. The transformer according to claim 33, wherein the single-layer and the multilayer spiral coil are connected in series with two ends exposed out of the core.

35. The transformer according to claim 30, wherein the first electrical conductor comprises at least one conductive sheet.

36. The transformer according to claim 35, wherein the conductive sheet is made of copper.

37. The transformer according to claim 35, wherein the conductive sheet is ring-shaped and has a first through hole at a central portion of the conductive sheet.

38. The transformer according to claim 35, wherein the conductive sheet is U-shaped and has two ends exposed outside the core for electrically connecting to a circuit board or an external member.

39. The transformer according to claim 30, wherein the first electrical conductor comprises a plurality of conductive sheets, and the conductive sheets are formed as individual parts.

40. The transformer according to claim 30, wherein the first electrical conductor comprises a plurality of conductive sheets, and the conductive sheets are integrally formed as a single piece.

41. The transformer according to claim 40, wherein the first electrical conductor further comprises a turning portion for connecting the conductive sheets together and the conductive sheets are integrally formed as a single piece.

42. The transformer according to claim 30, wherein the second electrical conductor further comprises a single-layer spiral coil electrically connected with the multilayer spiral coil.

43. The transformer according to claim 42, wherein the single-layer and the multilayer spiral coil are connected in series with two ends exposed out of the core.

44. The transformer according to claim 42, wherein the first electrical conductor comprises at least one conductive sheet disposed between the single-layer spiral coil and the multilayer spiral coil.

45. The transformer according to claim 44, wherein the conductive sheet is made of copper.

46. The transformer according to claim 44, wherein the conductive sheet is ring-shaped and has a first through hole at a central portion of the conductive sheet.

47. The transformer according to claim 44, wherein the conductive sheet is U-shaped and has two ends exposed out of the core for electrically connecting to a circuit board or an external member.

48. The transformer according to claim 30, wherein the first electrical conductor comprises a plurality of conductive sheets, and the conductive sheets are formed as individual parts.

49. The transformer according to claim 30, wherein the first electrical conductor comprises a plurality of conductive sheets, and the conductive sheets are integrally formed as a single piece.

50. The transformer according to claim 49, wherein the first electrical conductor further comprises a turning portion for connecting the conductive sheets together, and the conductive sheets are integrally formed as a single piece.

51. The transformer according to claim 30, wherein the conductive wire is an enameled wire, a triple insulated wire or a self-adhesive wire.

52. The transformer according to claim 30, wherein the multilayer spiral coil has an even number of winding layers.

53. The transformer according to claim 30, wherein the core comprises a first core and a second core opposite to the first core, and the first core and the second core are fit with the through hole.

54. The transformer according to claim 53, wherein the core is an EE-type core, an EI-type core, a RM-type core, an E-type core, a PQ-type core, an BC-type core, an ETD-type core, or a core with any other shape.

55. The transformer according to claim 30, wherein the transformer is for modulating a voltage or a current of a power source.

* * * * *